US011611161B2

(12) United States Patent
Bednarek

(10) Patent No.: US 11,611,161 B2
(45) Date of Patent: Mar. 21, 2023

(54) TOOL FOR SOLDERING AN ELECTRICAL CONDUCTOR WITH A CONNECTION DEVICE

(71) Applicant: Tyco Electronics France SAS, Pontoise (FR)

(72) Inventor: Alain Bednarek, Neuilly en Vexin (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 16/598,045

(22) Filed: Oct. 10, 2019

(65) Prior Publication Data

US 2020/0044369 A1 Feb. 6, 2020

Related U.S. Application Data

(63) Continuation of application No. PCT/EP2018/059434, filed on Apr. 12, 2018.

(30) Foreign Application Priority Data

Apr. 13, 2017 (FR) ..... 1753269

(51) Int. Cl.
*H01R 4/18* (2006.01)
*H01R 43/02* (2006.01)
*H01R 43/048* (2006.01)

(52) U.S. Cl.
CPC ..... *H01R 4/187* (2013.01); *H01R 43/0214* (2013.01); *H01R 43/048* (2013.01)

(58) Field of Classification Search
CPC .. H01R 43/0214; H01R 4/187; H01R 43/048; H01R 4/182; H01R 4/06; H01R 43/04;
(Continued)

(56) References Cited

U.S. PATENT DOCUMENTS 1,836,497 A * 12/1931 Phelps ..... H01R 43/048 29/33.52
2,632,070 A * 3/1953 Verkuil ..... G08B 25/12 200/52 R
(Continued)

FOREIGN PATENT DOCUMENTS

DE 19651513 A1 6/1997
EP 3113287 A1 1/2017
(Continued)

OTHER PUBLICATIONS

Abstract of WO8805149 corresponding to EP0296188, dated Dec. 28, 1988, 1 page.
(Continued)

*Primary Examiner* — Eric S Stapleton
(74) *Attorney, Agent, or Firm* — Barley Snyder

(57) ABSTRACT

A tool for soldering an electrical conductor with a connection device includes a deformation unit plastically deforming the connection device around the electrical conductor. The deformation unit has a fixed deformation module and a movable deformation module that is movable with respect to the fixed deformation module. The fixed deformation module has an anvil with an electrical contact area on which the electrical conductor and the connection device are disposed. An electric current circulates through the electrical conductor and the connection device by passing through an electrically conductive first part of the anvil that is electrically insulated from a rest of the anvil.

15 Claims, 4 Drawing Sheets

(58) Field of Classification Search
CPC .. H01R 43/20; H01R 43/0486; H05K 3/4084; H05K 3/202; H05K 1/0251; Y10T 29/53226; Y10T 29/53265; Y10T 29/53235; Y10T 29/5193; Y10T 29/49218; Y10T 29/53209; Y10T 29/49185; Y10T 29/4919; Y10T 29/53217; Y10T 29/5149; Y10T 29/49222; Y10T 29/49004; Y10T 29/53022; B21D 39/031; B30B 15/0094
USPC ..... 219/85.16
See application file for complete search history.

(56) References Cited

U.S. PATENT DOCUMENTS 3,405,024 A * 10/1968 Attwood ..... B29C 65/08 156/73.1
3,650,450 A * 3/1972 Larson ..... B23K 3/00 228/46
4,019,362 A * 4/1977 McKeever ..... H01R 43/04 72/421
4,025,999 A * 5/1977 Wolyn ..... H01R 43/0488 29/753
4,130,934 A * 12/1978 Asick ..... H02G 1/1295 29/882
4,134,201 A * 1/1979 McDonough ..... H01R 43/058 29/566.2
4,272,879 A * 6/1981 Wigby ..... H01R 43/04 29/566.2
4,273,581 A * 6/1981 Inoue ..... B22F 3/02 100/38
4,315,128 A * 2/1982 Matcovich ..... H01L 24/78 219/223
4,326,764 A * 4/1982 Asick ..... H01R 12/616 439/405
4,521,960 A * 6/1985 Maack ..... H01R 43/01 29/749
4,682,400 A * 7/1987 Casey ..... H01R 43/01 29/564.7
4,920,642 A * 5/1990 Yanai ..... H01R 12/592 29/860
4,981,451 A * 1/1991 Undin ..... H01R 4/185 29/884
5,070,797 A * 12/1991 Rietzscher ..... F27B 1/16 110/106
5,092,026 A * 3/1992 Klemmer ..... B30B 15/0094 29/593
5,119,546 A * 6/1992 Cameron ..... H01R 43/048 29/705
5,122,043 A * 6/1992 Matthews ..... B01J 3/006 425/77
5,153,984 A * 10/1992 Beetz ..... H01R 43/042 29/751
5,173,766 A * 12/1992 Long ..... H01L 21/50 257/687
5,276,964 A * 1/1994 Anderson, Jr ..... H05K 3/4015 29/441.1
5,289,713 A * 3/1994 Schafer ..... H01R 43/0488 100/257
5,432,995 A * 7/1995 Takenami ..... H01R 43/048 29/33 M
5,496,356 A * 3/1996 Hudz ..... A61N 1/326 463/47.3
5,808,260 A * 9/1998 Asakura ..... H01R 4/187 219/56.22
6,230,406 B1 * 5/2001 Balfour ..... H01R 43/048 29/745
6,231,944 B1 * 5/2001 Holt ..... B21D 39/031 428/57
6,327,775 B1 * 12/2001 Oishi ..... H01R 43/055 29/33 M
6,367,148 B1 * 4/2002 Caveney ..... H01R 43/055 29/33 M
6,530,257 B2 * 3/2003 Ooji ..... H01R 43/055 29/753
7,448,823 B2 * 11/2008 Silva ..... F16G 15/06 403/325
7,650,914 B2 * 1/2010 Bogursky ..... H01R 4/188 140/105
7,926,520 B2 * 4/2011 Bogursky ..... H01R 4/188 140/105
8,544,166 B2 * 10/2013 Particka ..... H01R 43/048 29/753
8,973,256 B2 * 3/2015 Particka ..... H01R 43/048 29/753
9,484,701 B2 * 11/2016 Particka ..... H01R 43/055
9,583,905 B2 * 2/2017 Particka ..... H01R 43/048
10,290,989 B2 * 5/2019 Particka ..... H01R 43/048
10,454,234 B2 * 10/2019 Particka ..... H01R 43/055
2002/0184753 A1 * 12/2002 Wilson ..... H01R 43/048 29/751
2003/0008548 A1 * 1/2003 Ueda ..... H01R 4/2495 439/422
2003/0196828 A1 * 10/2003 Schilson ..... B29C 66/433 174/117 F
2004/0134415 A1 * 7/2004 D'Evelyn ..... B01J 3/065 117/84
2005/0087055 A1 * 4/2005 Ruchti ..... H01R 43/052 83/694
2006/0099862 A1 * 5/2006 Yoneya ..... H01R 9/0518 439/877
2007/0079501 A1 * 4/2007 Garner ..... H01R 43/055 29/753
2007/0117476 A1 * 5/2007 Kumakura ..... H01R 4/185 439/885
2007/0294873 A1 * 12/2007 Bogursky ..... H01R 43/048 174/840
2009/0250154 A1 * 10/2009 Nagano ..... H05K 3/326 156/73.5
2010/0119863 A1 * 5/2010 Bogursky ..... H01R 4/188 428/603
2010/0120298 A1 * 5/2010 Eba ..... H01R 4/184 439/741
2010/0230160 A1 * 9/2010 Ono ..... H01R 4/188 174/840
2011/0021092 A1 * 1/2011 Ukai ..... H01R 43/048 439/877
2011/0099801 A1 * 5/2011 Particka ..... H01R 43/048 29/753
2011/0177728 A1 * 7/2011 Uchiyama ..... H01R 4/188 439/877
2012/0132251 A1 * 5/2012 Sedlacek ..... H01L 31/048 136/244
2013/0273787 A1 * 10/2013 Mitose ..... C25D 11/246 439/878
2014/0026407 A1 * 1/2014 Particka ..... H01R 43/048 29/753
2014/0227527 A1 * 8/2014 Brors ..... F27B 14/10 428/411.1
2014/0245601 A1 * 9/2014 Viviroli ..... H01R 43/052 29/753
2014/0245602 A1 * 9/2014 Particka ..... H01R 43/055 29/753
2014/0283382 A1 * 9/2014 Schuetz ..... H01R 43/052 29/863
2014/0374154 A1 * 12/2014 Frohler ..... H05K 3/4084 174/84 C
2015/0114550 A1 * 4/2015 Kurtz ..... B29C 66/5346 156/228
2015/0162717 A1 * 6/2015 Particka ..... H01R 43/048 29/753
2015/0200513 A1 * 7/2015 Isus Feu ..... H01R 4/187 228/155
2015/0244133 A1 * 8/2015 Hanazaki ..... H01R 43/24 174/74 R
2015/0333465 A1 * 11/2015 Ofenbakh ..... H01R 13/629 29/865

(56) References Cited

U.S. PATENT DOCUMENTS

| | | | | |
|---|---|---|---|---|
| 2015/0364838 | A1* | 12/2015 | Tonoike | H01R 4/183<br>439/879 |
| 2016/0144421 | A1* | 5/2016 | Briese | B21D 53/74<br>29/897.312 |
| 2016/0172786 | A1* | 6/2016 | Sussman | H01R 43/048<br>439/449 |
| 2017/0085049 | A1* | 3/2017 | Fin | H01R 43/048 |
| 2017/0162995 | A1* | 6/2017 | Particka | H01R 43/048 |

FOREIGN PATENT DOCUMENTS

| | | | |
|---|---|---|---|
| JP | 3198975 | A | 8/1991 |
| WO | 8805149 | A1 | 7/1988 |

OTHER PUBLICATIONS

PCT Notification of Transmittal of The International Search Report and the Written Opinion, International Application No. PCT/EP2018/059434, dated Jun. 11, 2018, 12 pages.
Preliminary Report, dated Nov. 21, 2017, 6 pages.
Notice of Reasons for Refusal and English translation, dated Oct. 27, 2020, 11 pages.
The Second Office Action and English translation, dated Nov. 10, 2020, 17 pages.
Abstract of JPH03198975, dated Aug. 30, 1991, 1 page.

* cited by examiner

TOOL FOR SOLDERING AN ELECTRICAL CONDUCTOR WITH A CONNECTION DEVICE

CROSS-REFERENCE TO RELATED APPLICATIONS

This application is a continuation of PCT International Application No. PCT/EP2018/059434, filed on Apr. 12, 2018, which claims priority under 35 U.S.C. § 119 to French Patent Application No. 1753269, filed on Apr. 13, 2017.

FIELD OF THE INVENTION

The present invention relates to a tool for soldering and, more particularly, to a tool for soldering an electrical conductor with a connection device.

BACKGROUND

A tool for soldering described in European Patent Application No. 296188A1 comprises a deformation unit having a fixed module and a movable module to deform a connection device around an electrical conductor. A solder joint is produced between the connection device and the electrical connector to further improve the electrical contact between the conductor and the connection device. The heat necessary to create the solder joint is generated by Joule effect at the junction of the electrical connector and the connection device. The tool makes it possible to obtain reliable and stable electrical connections, even when the electrical wires to be connected are small and/or made of aluminum.

The patent application EP 296188A1 describes two alternatives. In the first alternative, the electric current for creating the Joule effect circulates through a movable punch and passes into an upper surface of the electrical conductor and of the connection device to be soldered. In the other alternative, the electric current is brought through the punch, then passes through the electrical conductor and the connection device, and exits via an anvil of the fixed module.

The tool, however, consumes a great deal of electricity to reach a temperature which is sufficiently high to be able to perform the solder. Further, it is difficult to limit the heating to the desired area, notably in order to reduce the impact of the heat on any insulation present on the electrical conductor and/or the connection device.

SUMMARY

A tool for soldering an electrical conductor with a connection device includes a deformation unit plastically deforming the connection device around the electrical conductor. The deformation unit has a fixed deformation module and a movable deformation module that is movable with respect to the fixed deformation module. The fixed deformation module has an anvil with an electrical contact area on which the electrical conductor and the connection device are disposed. An electric current circulates through the electrical conductor and the connection device by passing through an electrically conductive first part of the anvil that is electrically insulated from a rest of the anvil.

BRIEF DESCRIPTION OF THE DRAWINGS

The invention will now be described by way of example with reference to the accompanying Figures, of which.

DETAILED DESCRIPTION OF THE EMBODIMENT(S)

Figure 1A:
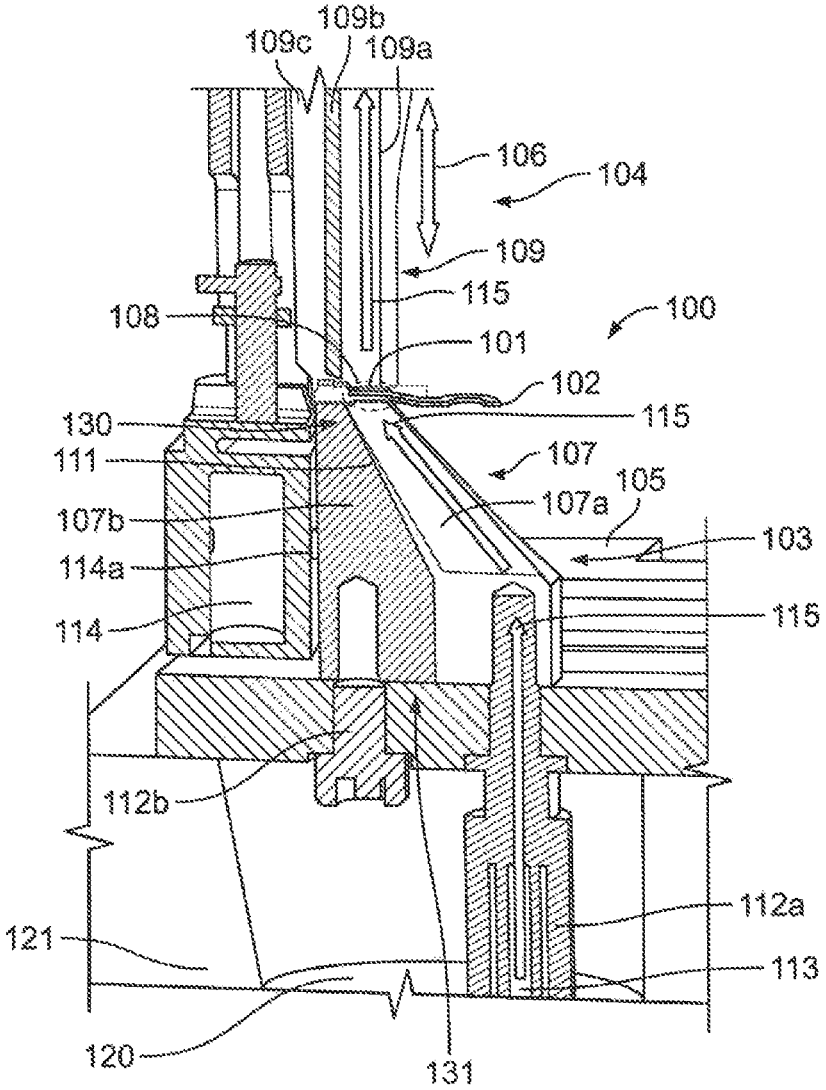
FIG. 1A is a sectional perspective view of a tool for soldering according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will convey the concept of the invention to those skilled in the art. Characteristics and alternatives of any embodiment may be combined, independently of one another, with characteristics and alternatives of any other embodiment.

A tool 100 for soldering an electrical conductor 101 with a connection device 102 according to an embodiment is shown in FIG. 1A. The electrical conductor 101 and the connection device 102 are shown in FIG. 1B.

Figure 1B:
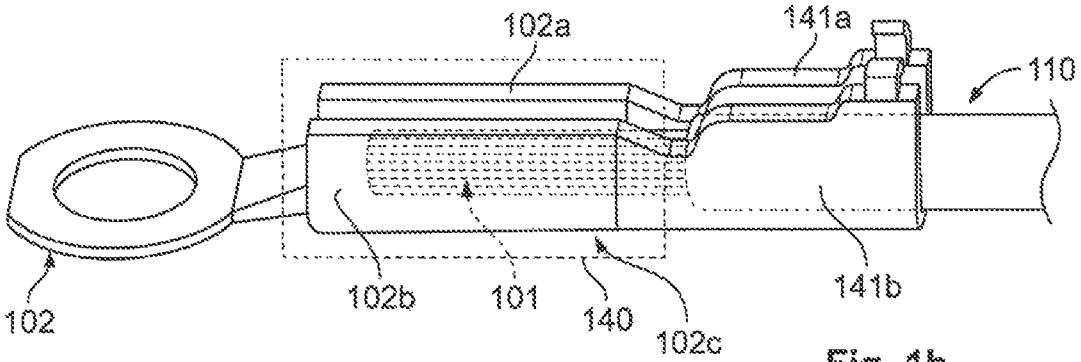
FIG. 1B is a perspective view of an electrical conductor and a connection device.

The electrical conductor 101, as shown in FIG. 1B, has a part provided with an insulation 110 and a part which is not provided with insulation and which is placed at a crimping shaft 102*c* of the connection device 102. The connection device 102 has a pair of crimp flanks 102*a*, 102*b* which extend along a first side and an opposite second side of the crimping shaft 102*c*. The crimping flanks 102*a*, 102*b* are deformed so as to surround the electrical conductor 101. A soldering area 140 corresponds to the area in which the crimping flanks 102*a*, 102*b* of the connection device 102 are soldered to each other in order to ensure the electrical contact between the electrical conductor 101 and the connection device 102. The connection device 102 also has a second set of insulation flanks 141*a*, 141*b* which are deformed around the insulation 110.

In some embodiments, in particular for a copper electrical conductor 101 of small cross-section, there may also be a soldering area directly between the copper electrical conductor 101 and the crimping shaft 102*c*, in addition to a solder between the crimping flanks 102*a*, 102*b*, in order to further strengthen the electrical contact.

The tool 100, as shown in FIG. 1A, has a fixed deformation module 103 and a movable deformation module 104. The deformation modules 103, 104 are used to deform the flanks 102*a*, 102*b* and 141*a*, 141*b* of the connection device 102 around the electrical conductor 101 and also to perform the soldering.

As shown in FIG. 1A, the fixed deformation module 103 is statically and immovably mounted on a fixing plate 105 while the movable deformation module 104 is movable with respect to the fixed deformation module 103, which is indicated by the double-headed arrow 106.

The fixed deformation module 103 has an anvil 107. When the tool 100 is in use, the connection device 102 and the electrical conductor 101 are placed at a peak 130 of the anvil 107 of the fixed deformation module 103.

The movable deformation module 104, as shown in FIG. 1A, has a punch 109 which may be displaced so as to press on the electrical conductor 101 and the connection device 102 in order to plastically deform the crimping flanks 102*a*, 102*b* of the connection device 102 around the electrical conductor 101 when the tool 100 is used.

The punch 109 includes several parts, as shown in FIG. 1A, including a first part 109*a*, a second part 109*b*, and a third part 109*c*. The first part 109*a* and the second part 109*b* press onto the electrical conductor 101, while the third part 109*c* presses onto the insulation flanks 141*a*, 141*b* at the insulation 110. The punch 109 is configured such that an electric current I is capable of passing through it.

The first electrically conductive part 109*a* of the punch 109 is electrically insulated from the rest of the punch 109. The second part 109*b* may be electrically insulating. In this embodiment, the punch 109 is configured such that an electric current I is capable of passing through the first conductive part 109*a* which is insulated from the rest of the punch 109. When the tool 100 is being used, the first part 109*a* of the punch 109 presses onto the electrical conductor 101 at the soldering area 140. The third part 109*c* presses at the insulation 110 of the electrical conductor 101. The second electrically insulating part 109*b* presses at a transition between the flanks 102*a/b* and 141*a/b*.

The anvil 107 of the fixed deformation module 103 is capable of making an electric current I circulate through the electrical conductor 101 and the connection device 102 while the tool 100 is being used. The anvil 107, as shown in FIG. 1A, has a first electrically conductive part 107*a* which is electrically insulated from the rest of the anvil 107. The anvil 107, and in particular the first part 107*a*, is manufactured from a steel capable of withstanding a high temperature, such that a temperature in the order of 280° C. can be achieved in the electrical connector 101 to be soldered onto the connection device 102. The steel may be, for example, the W360 SFP 57 HRC type which withstands temperatures of around 600° C.

The first conductive part 107*a* is insulated from a second part 107*b* by an insulating interface 111, shown in FIG. 1A, which forms the rest of the anvil 107. In FIG. 1A, the insulating interface 111 extends from a base 131 to the peak 130 of the anvil 107. The insulating interface 111 is, for example, a ceramic layer. In an embodiment, the surface of the peak 130 of the second part 107*b* of the anvil 107 is also covered with insulation or the second part 107*b* is made of an electrically insulating material. Thus, the electric current I may only circulate in a limited part of the anvil 107, and it is also possible to reduce the volume of the anvil 107 which will be heated, which extends the lifespan of the anvil 107. An electrical contact area 108 is formed at the peak 130 of the anvil 107, at the first part 107*a*.

The base 131 of the anvil 107 is fixed to the fixing plate 105 a plurality of screws 112*a* and 112*b*, as shown in FIG. 1A. The electrical connection of the anvil 107 to a current generator is also performed via one of the screws, here screw 112*a*, which simplifies the design of the fixed deformation module 103. The screw 112*a*, which crimps the electrical supply cable 113 of the current generator, is electrically conductive so as to be capable of routing the electric current in the anvil 107. The screws 112*a*,112*b*, as well as the electrical supply 113, extend into an aperture 120 inside a frame 121 on which the fixing plate 105 of the tool 100 is located.

In the embodiment shown in FIG. 1A, the anvil 107 is positioned beside a carrier strip cutting device 114 which allows the electrical conductor 101 to be cut off from a neighboring electrical conductor. An insulating element 114*a* is placed onto an outer surface of the carrier strip cutting device 114 in order to electrically insulate it from the anvil 107 to prevent losses of electric current circulating in the anvil 107 toward the carrier strip cutting device 114. The insulation 114*a* may be manufactured from a ceramic material or from another material which is electrically insulating. In another embodiment, the insulation 114*a* could also be placed onto an outer surface of the anvil 107.

The anvil 107 is electrically insulated with respect to the fixing plate 105. This may be performed using an insulating fixing plate 105, shown in FIG. 1A, manufactured from ceramic material, for example. In another embodiment, the fixing plate 105 may be covered with insulation at least on the area in which the anvil 107 and the fixing plate 105 are in contact. In another embodiment, insulating inserts may be introduced between the anvil 107 and the fixing plate 105.

The operation of the tool 100 will now be described in greater detail with reference to FIGS. 1A and 1B.

When the fixed deformation module 103 and the movable deformation module 104 are spaced apart from one another, the electrical conductor 101 and the connection device 102 to be assembled with one another are placed at the peak 130 of the anvil 107 in such a manner that the part of the electrical conductor 101 to be soldered and the part of the connection device 102 to be soldered are placed onto the first conductive part 107*a* of the anvil 107.

The punch 109 of the movable deformation module 104 is then displaced towards the anvil 107 to deform the crimp flanks 102*a*, 102*b* of the connection device 102 around the electrical conductor 101 and the insulation flanks 141*a*, 141*b*. The first conductive part 109*a* of the punch 109 comes back into contact with the part of the electrical conductor 101 to be soldered and the part of the connection device 102 to be soldered while the third part 109*c* of the punch 109 presses on the insulation flanks 141*a*, 141*b* at the insulation 110 of the electrical connector 101.

While the anvil 107 and the punch 109 are in contact with the electrical conductor 101 and the connection device 102, an electric current I is allowed to circulate via the first electrically conductive part 107*a* of the anvil 107. The electric current I is routed to the electrical contact area 108 at the peak 130 of the anvil 107 and then circulates through the electrical conductor 101 and the connection device 102 and thus makes it possible to solder them through the heat dissipated by Joule effect when a temperature of at least 260° Celsius is reached at the soldering area close to the electrical contact area 108. Then, as illustrated by the arrows 115, the electric current I flows out via the punch 109. By limiting the surface via which the current passes into the electrical conductor 101 and the connection device 102, it is possible to reduce the risk of damaging the insulation 110 of the electrical conductor.

In the geometry of the anvil 107 shown in FIG. 1A, the main part of the current passes through the first part 109*a* of the punch 109. This effect is even more pronounced if the first part 109*a* is electrically insulated from the rest of the punch 109. In an embodiment, the current will also be able to pass in the other direction or an alternating current will also be able to be applied.

By limiting the passage of the electric current to the punch 109 and to only one part of the anvil 107, the tool 100 makes it possible to improve the control of the heating area and to facilitate or even improve the solder compared with the tool known from the prior art. In an embodiment, with an electric current of around 750A at an applied voltage in the order of 1 to 2 V, the solder joint may be obtained in approximately 150 milliseconds. The supply of electric current is then interrupted. The electrical connector 101 and the connection device 102 which are soldered then cool for 200 to 300 milliseconds before being freed by the displacement of the punch 109 of the movable deformation module 104 to open the tool 100.

Figure 2A:
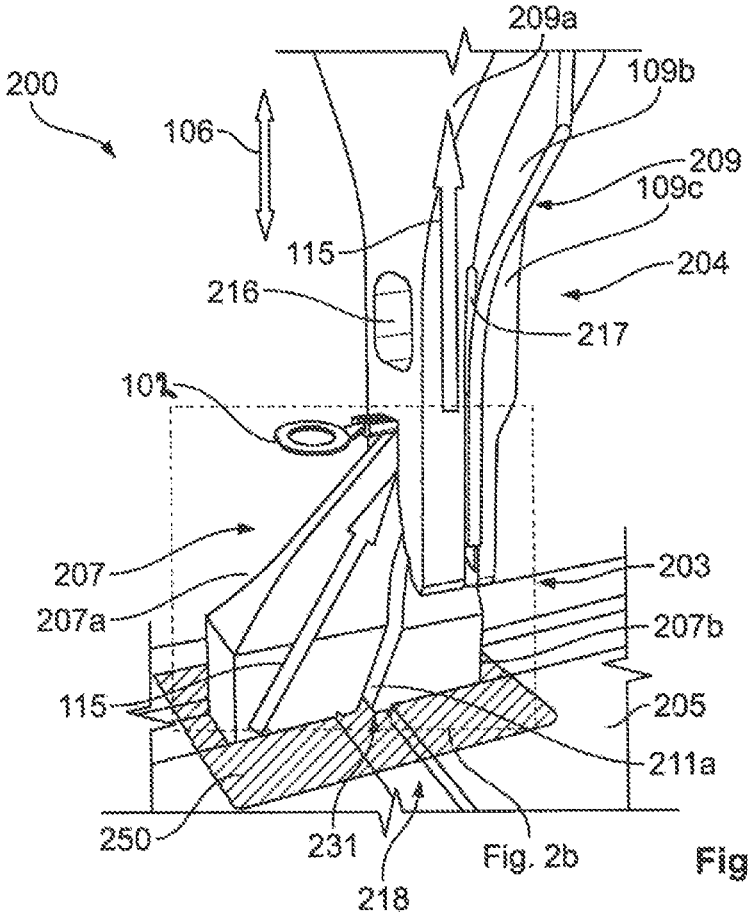
FIG. 2A is a perspective view of a tool for soldering according to another embodiment.
Figure 2B:
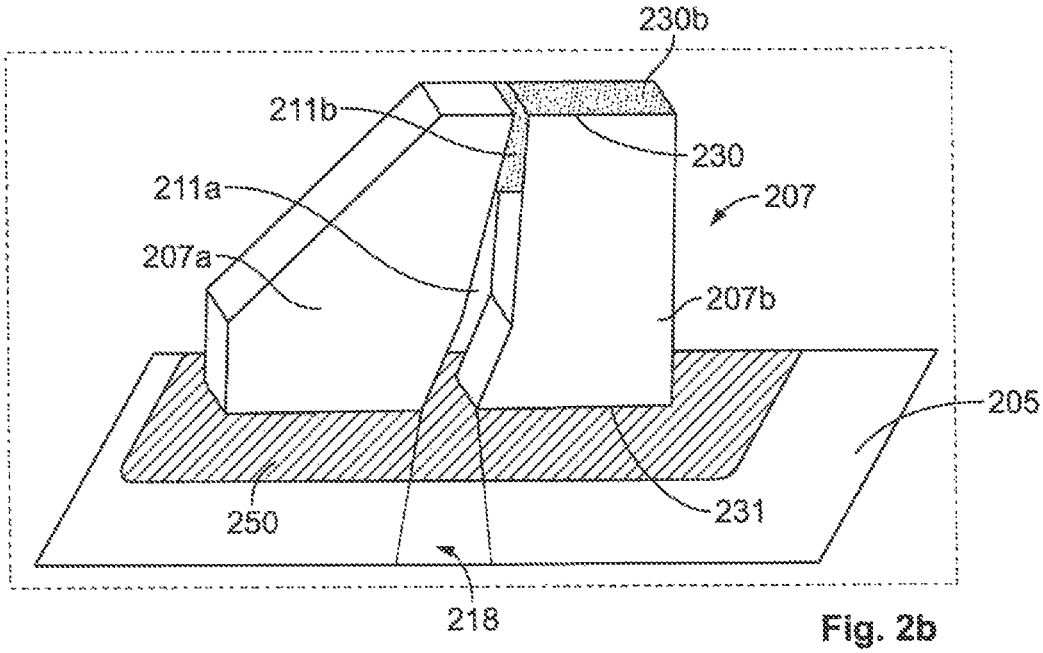
FIG. 2B is a perspective view of an anvil of the tool of FIG. 2A.

A tool 200 according to another embodiment, as shown in FIGS. 2A and 2B, includes a fixed deformation module 203 and a movable deformation module 204 which operate in the same manner as the fixed deformation module 103 and movable deformation module 104 from the first embodiment but with a punch 209 and an anvil 207 with a different structure. Elements bearing the same reference numbers as in the first embodiment of the invention illustrated in FIGS. 1A and 1B will not be described anew, but reference is made to the descriptions thereof above.

The punch 209 of the movable deformation module 204, as shown in FIG. 2A, includes several parts, including an electrically conductive first part 209*a*. In an embodiment, the first part 209*a* may be insulated from the rest of the punch 209, for example via a second electrically insulating part 109*b* and a third part 109*c*. The punch 209 is therefore also configured in such a manner that the electric current I is capable of passing through the punch 209.

The first part 209*a* of the punch 209, as shown in FIG. 2A, has an aperture 216. The first conductive part 209*a* and the second part 109*b*, which is electrically insulating, of the punch 209 are partially separated by a gap 217 or a slot. The aperture 216 may be of any shape and may or may not entirely pass through the first part 209*a*. In some embodiments, there may also be several apertures 216 of the same and/or different sizes and shapes. Similarly, instead of having a gap 217 between the first part 209*a* and the second insulating part 109*b*, there may be several gaps 217 of the same sizes and shapes and/or different sizes and shapes. In another embodiment, an aperture 216 or a gap 217 may be present. The aperture 216 may be of 5 millimeters by 5 millimeters in size over the entire thickness of the punch 209. The gap 217 may measure 8 millimeters high by 0.2 millimeters deep.

The use of the apertures 216 and/or gaps 217 makes it possible to bring the hottest area closer to the electrical contact area 108, and therefore to the area in which attempts are made to reach the highest temperature to be able to perform the solder. The hottest point in the anvil 207 is positioned just below the peak 230 of the anvil 207. Thus, after the current has been cut, fast cooling of the soldered-together electrical connector 101 and the connection device 102 is obtained.

The fixed deformation module 203, as shown in FIGS. 2A and 2B, has an anvil 207 which has the same function and the same electrical supply as the anvil 107 described in the embodiment of FIG. 1A. The anvil 207 is manufactured from the same materials with the same properties as the anvil 107.

The anvil 207, as shown in FIGS. 2A and 2B, has a first conductive part 207*a* which is electrically insulated from a second part 207*b*. In contrast to the anvil 107, the insulating interface of the anvil 207 comprises two parts 211*a* and 211*b*. The first part 207*a* and the second part 207*b* of the anvil 207 are insulated from one another by an aperture 211*a* at a base 231 of the anvil 207. At the peak 230 of the anvil 207, the two parts 207*a* and 207*b* are electrically insulated by an insulating interface 211*b*. In an embodiment, the insulating interface 211*b* is made of ceramic material, but could also be made of diamond-type carbon or of another electrically insulating material. In an embodiment, the first part 207*a* of the anvil 207 has one or more apertures like the punch 209 to be able to displace the point of the hottest area toward the electrical contact area 108.

In an embodiment, a peak 230*b* of the second part 207*b*, shown in FIG. 2B, may also be covered with a ceramic or diamond-type carbon insulating coating in order to improve its electrical insulation close to the electrical contact area 108 located on the first part 207*a* of the anvil 207. As the second part 207*b* of the anvil 217 may be heated only by mechanical contact with the first part 207*a* of the anvil 207 in which the electric current I circulates, the insulating coating is less thermally loaded than if it was performed directly on the first part 207*a* of the anvil 207. The electric current I may therefore only circulate in a limited part of the anvil 207. The soldering area 140 during use can therefore be better controlled.

As shown in FIGS. 2A and 2B, a part 207*a* of the anvil 207 is also electrically insulated with respect to the fixing plate 205 via an insulating coating 250. Furthermore, the fixing plate 205 and thus the coating 250 is provided with a channel 218 in order to insulate to an even greater degree the first and second parts 207*a* and 207*b* of the anvil 207, each being fixed at one side of the channel 218, respectively. In an embodiment, the fixing plate 205 may be made of an insulating material or comprise inserts of an insulating material.

The operation of the tool 200 is similar to that of the tool 100 described in greater detail in the description of FIG. 1A. The particular geometry of the punch 209 and of the anvil 207 makes it possible to control the localization of the heating area and to concentrate the heat toward the electrical contact area 108 and thus in the soldering area 140 of the electrical conductor 101 and the connection device 102 in order to facilitate the soldering.

Figure 3:
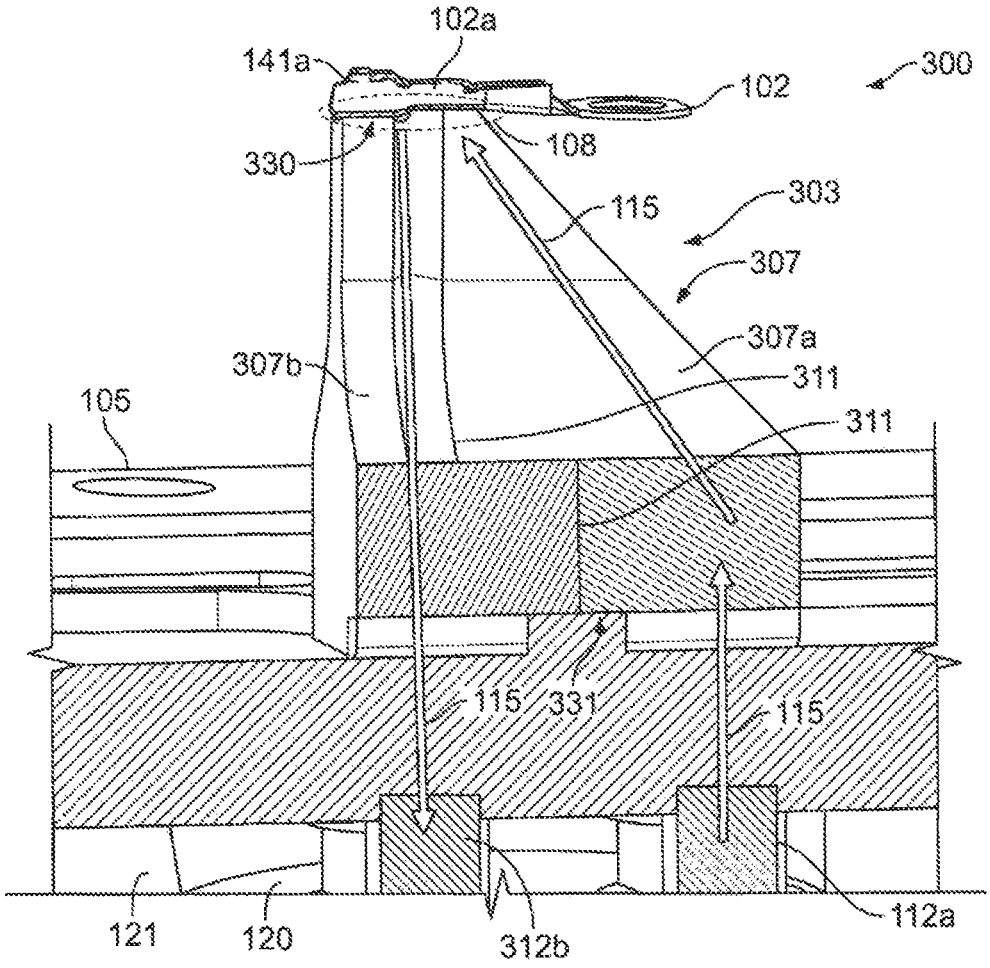
FIG. 3 is a sectional perspective view of a tool for soldering according to another embodiment.

A tool 300 according to another embodiment, as shown in FIG. 3, includes a movable deformation module, which is not shown in FIG. 3 but may be structurally similar to the deformation module 104 or to the deformation module 204 which are described in the two preceding embodiments. In the tool 300, the punch is isolated from the earth in order to avoid the punch losing current. Elements bearing the same reference numbers as in the preceding embodiments will not be described anew, but reference is made to the descriptions thereof above.

A fixed deformation module 303, as shown in FIG. 3, has an anvil 307 capable of making an electric current I circulate through the electrical conductor 101 and the connection device 102. The anvil 307 has two electrically conductive parts 307*a* and 307*b* which are electrically insulated from one another by an insulating interface 311. The insulating interface 311 is, for example, a ceramic layer which extends from a base 331 to a peak 330 of the anvil 307. The anvil 307 is manufactured from the same materials with the same properties as those set out in the description of the first and the second embodiments of the anvil 107, 207.

The anvil 307, as shown in FIG. 3, is fixed to the fixing plate 105 by a plurality of screws 112*a*, 312*b* introduced into the aperture 120 in the frame 121. The electrical connection with the anvil 307 is produced for the first and the second parts 307*a* and 307*b* of the anvil 307. The connection with a current generator is also established via screws 112*a*, 312*b*, which simplifies the design of the fixed deformation module 303. The screws 112*a*, 312*b*, which crimp the electrical supply cables 113 of the current generator, are therefore conductive in order to be capable of making the electric current flow into and out of the anvil 307.

The operation of the tool 300 will now be described in greater detail with reference to FIG. 3. The plastic deformation of the crimping flanks 102*a*, 102*b* and of the insulation flanks 141*a*, 141*b* of the device 102 around the electrical conductor 101, shown in FIG. 1B, is accomplished in the same manner as in the first and second embodiments by the punch of the movable deformation module.

In the tool 300, the electric current I is routed into the first part 307*a* from the base 331 to the peak 330 of the anvil 307 and then circulates through the electrical conductor 101 and the connection device 102 then, as illustrated by the arrows 115, the electric current I returns into the second part 307*b* of the anvil 307 and exits from the second conductive part 307*b* to the base 331 of the anvil 307. In other embodiments, the current I may also pass in the other direction or an alternating current may be used.

The electrical contact area 108 is located on the first part 307*a* and the second part 307*b* of the anvil 307, as shown in FIG. 3. The electric current which serves to heat the conductor 101 and the connection device 102 therefore passes only into the fixed part of the deformation module 303. Given that, the electric current I does not pass into the punch of the fixed deformation module, the contact geometry of which is typically more complex than that of the anvil 307, and which, moreover, corresponds to a moving element, this third embodiment thus makes it possible to simplify the electrical assembly.

Figure 4:
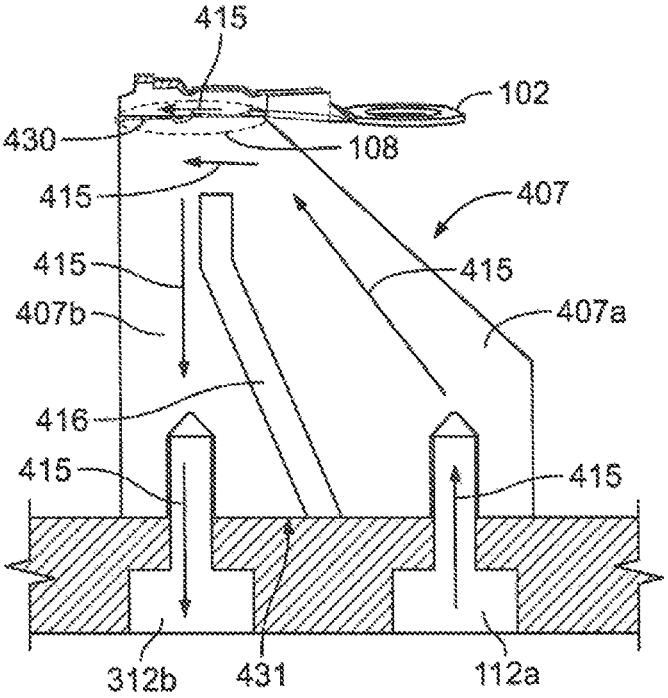
FIG. 4 is a sectional side view of an anvil according to another embodiment.

A tool 400 according to another embodiment, as shown in FIG. 4, includes an anvil 407 that is different from the anvil 307.

The anvil 407, as shown in FIG. 4, has a first electrically conductive part 407*a* and a second electrically conductive part 407*b* which are directly linked without the interposition of electrical insulation at their peak 430 at the electrical contact area 108. Moreover, the first and the second parts 407*a* 407*b* are electrically insulated from one another by an aperture 416 at a base 431 of the anvil 407. As in the tool 300, the anvil 407 may be fixed to a fixing plate 105 and be electrically connected thereto. In an embodiment, instead of using an aperture 416 to insulate the two parts 407*a*, 407*b* at the base 431, it is also possible to arrange insulation such as a ceramic layer or diamond-type amorphous carbon layer.

In the tool 400, the electric current 415 not only passes through the conductor 101 and the connection device 102 at the electrical contact area 108 to form the soldering area 140, as in the tool 300 from FIG. 3, but also just below the peak 430 of the anvil 407. The operation of the tool 400 nevertheless remains similar to that of the tool 300. This is because the electric current which serves to heat the soldering area 140 also passes only into the fixed part of the deformation module. In this embodiment, the electric current I does not pass into the punch, the contact geometry of which is typically more complex than that of the anvil 407, and which, moreover, corresponds to a moving element, this embodiment thus also makes it possible to simplify the electrical supply needs for ensuring the soldering.

What is claimed is:

1. A tool for soldering an electrical conductor with a connection device, comprising:

a deformation unit plastically deforming the connection device around the electrical conductor, the deformation unit having a fixed deformation module and a movable deformation module that is movable with respect to the fixed deformation module, the fixed deformation module having an anvil with an electrical contact area on which the electrical conductor and the connection device are disposed, an electric current circulating through the electrical conductor and the connection device by passing through an electrically conductive first part of the anvil that is electrically insulated from a remainder of the anvil, the anvil having an aperture defined between the first part of the anvil and the remainder of the anvil and an insulating material arranged within the aperture, the insulating material and the aperture separating and electrically isolating the first part of the anvil from the remainder of the anvil, an electrical connection to the first part of the anvil includes an electrical supply cable of a current electrically connected thereto for routing the electric current through the first part of the anvil.

2. The tool of claim 1, wherein the movable deformation module has a punch, a first part of the punch is electrically conductive and is electrically insulated from a rest of the punch.

3. The tool of claim 2, wherein the electric current circulates through the first part of the punch.

4. The tool of claim 2, wherein the punch has an aperture, a slot, and/or a gap disposed at an interface between the first part of the punch and an insulating part of the punch.

5. The tool of claim 1, wherein the electrical contact area is disposed only on the first part of the anvil.

6. The tool of claim 1, wherein the insulating material is arranged within a first portion of the aperture, with a remainder of the aperture being unoccupied.

7. A tool for soldering an electrical conductor with a connection device, comprising:

a deformation unit plastically deforming the connection device around the electrical conductor, the deformation unit having a fixed deformation module and a movable deformation module that is movable with respect to the fixed deformation module, the fixed deformation module having an anvil with an electrical contact area on which the electrical conductor and the connection device are disposed, an electric current circulating through the electrical conductor, the connection device, and the anvil to perform a soldering by flowing in and out of the fixed deformation module, an electrical connection to the anvil includes an electrical supply cable of a current generator electrically connected thereto for routing the electric current through the anvil, the anvil including:

an electrically conductive first part electrically insulated from a remainder of the anvil;

an aperture defined between the first part of the anvil and the remainder of the anvil; and a layer of insulating material arranged within the aperture, the insulating material and the aperture separating and electrically isolating the first part of the anvil from the remainder of the anvil.

8. The tool of claim 7, wherein the anvil has an electrically conductive second part electrically isolated from the first part, the electrical contact area is located on the first part and the second part of the anvil.

9. The tool of claim 8, wherein an insulating interface defined by the aperture and the layer of insulating material extends from a base of the anvil to the electrical contact area located at a peak of the anvil.

10. The tool of claim 8, wherein the first part and the second part of the anvil are linked at the electrical contact area and each have an insulating interface elsewhere.

11. The tool of claim 7, wherein the anvil is mounted on a fixing plate and an electrical supply of the anvil is performed via a base of the anvil and through the fixing plate.

12. The tool of claim 11, wherein the anvil is fixed to the fixing plate by a plurality of screws that are electrically conductive.

13. The tool of claim 12, wherein one of the plurality of screws crimps the electrical supply cable of the current generator.

14. The tool of claim 7, wherein the anvil is mounted on a fixing plate and the anvil is electrically insulated from the fixing plate.

15. The tool of claim 7, wherein the anvil has an outer part covered with an electrical insulation.

* * * * *